United States Patent [19]

Oppawsky et al.

[11] Patent Number: 4,987,310

[45] Date of Patent: Jan. 22, 1991

[54] POSITIVELY VENTILATED FINGERNAIL IRRADIATION DEVICE

[75] Inventors: Steffen Oppawsky, Bad Homburg; Holger Burckhardt, Frankfurt, both of Fed. Rep. of Germany

[73] Assignee: Heraeus Kulzer GmbH, Hanau, Fed. Rep. of Germany

[21] Appl. No.: 378,636

[22] Filed: Jul. 12, 1989

[30] Foreign Application Priority Data

Aug. 29, 1988 [DE] Fed. Rep. of Germany ..... 3829228

[51] Int. Cl.[5] ..... A61N 5/06

[52] U.S. Cl. ..... 250/492.1; 250/455.1; 250/504 R

[58] Field of Search ..... 250/492.1, 504 R, 455.1; 132/73

[56] References Cited

U.S. PATENT DOCUMENTS

| | | | |
|---|---|---|---|
| 3,826,014 | 7/1974 | Helding | 250/504 R |
| 4,207,288 | 6/1980 | Cauler et al. | 250/492.1 |
| 4,309,616 | 1/1982 | Wolff | 250/504 R |
| 4,563,589 | 1/1986 | Scheffer | 250/504 R |
| 4,694,180 | 9/1987 | Salisbury et al. | 250/492.1 |

FOREIGN PATENT DOCUMENTS

| | | |
|---|---|---|
| 8513789 | 12/1985 | Fed. Rep. of Germany . |
| 8609293 | 7/1986 | Fed. Rep. of Germany . |

OTHER PUBLICATIONS

W.P.I. Abstract of DE-OS3305173.

*Primary Examiner*—Jack I. Berman
*Assistant Examiner*—Kiet T. Nguyen
*Attorney, Agent, or Firm*—Frishauf, Holtz, Goodman & Woodward

[57] ABSTRACT

Light systems, in particular for curing photopolymerizable plastics on fingernails, are known which have an irradiation chamber in which one or more irradiation lamps are located and having a fan for ventilating the irradiation chamber, the fan being located in a region of the housing partitioned off from the irradiation chamber. To provide a light system, in particular for irradiating artificial fingernails, that has an adequate forced ventilation of the irradiation chamber regardless of the position of the fan in the housing and regardless of the flow courses, while still being compact in structure, an air distribution chamber is provided between the irradiation chamber and the suction or compression side of the fan. The air distribution chamber is partitioned off from the irradiation chamber by a wall having air openings, and with increasing distance from the suction or compression side of the fan, the cross-sectional area for the passage of air to the air treatment chamber is greater.

16 Claims, 1 Drawing Sheet

POSITIVELY VENTILATED FINGERNAIL IRRADIATION DEVICE

Cross-reference to related application, assigned to the assignee of the present invention: OPPAWSKY, U.S. Ser. No. 07/378,633, filed July 12, 1989.

The present invention relates to a light system, in particular for curing photopolymerizable plastics on fingernails, having an irradiation chamber in which one or more irradiation lamps are located, and having a fan to ventilate the treatment chamber; the fan is located in a region of the housing partitioned off from the irradiation chamber.

Background

Great numbers of such light systems, in particular for curing photopolymerizable plastics on fingernails, are known, for instance from German Utility Model DE-GM No. 85 13 789, NK-OPTIK GmbH, or German Utility Model DE-GM No. 86 09 293, Desonic-Kunststoff GmbH, which are similar to one another in their basic concept. These systems are tabletop units having an irradiation chamber that has a plurality of irradiation tubes in the region of the housing cover. A hand is introduced into these light systems, via an opening in the housing, in order to cure the plastic on the fingernails. Typically, the power system having the mains connection elements and the choke devices for the irradiation lamps is located on the side of the housing opposite the housing opening. In order to cool the irradiation chamber, which is heated by the irradiation tubes, these systems are provided with a fan, which draws the heated air out of the irradiation chamber. These fans are located centrally with respect to the housing axis, to attain a uniform aspirating air flow from all the areas in the irradiation chamber.

The Invention

With the above prior art as its point of departure, an object of the present invention is to provide a light system, especially for irradiating artificial fingernails, in which an adequate forced ventilation of the irradiation chamber is achieved, regardless of the position of the fan in the housing and regardless of the flow paths, while maintaining a compact design.

Briefly, this object is achieved by providing an air distribution chamber between the irradiation chamber and the suction or compression side of the fan; the air distribution chamber is partitioned off from the irradiation chamber by a wall having air flow openings, and the cross-sectional area for the passage of air to the air treatment chamber increases with increasing distance from the suction or compression side of the fan. By these provisions, the fan can be located outside the central axis of the housing or irradiation chamber, and uniform ventilation or venting of the irradiation chamber is accomplished by providing that only a few flow openings to the irradiation chamber are present in the vicinity of the fan, that is, in the region where the fan suction is strong, while at a greater distance, that is, in the region of lesser suction of the fan, the number of flow openings becomes greater.

The ventilation according to the invention is particularly advantageous for light systems for artificial fingernails, in which the longest dimension of the irradiation chamber must be in the vicinity of the central axis of the housing, where the middle finger having the fingernail to be irradiated is positioned.

So that the intensity of ventilation in the irradiation chamber can be varied subsequently as well, a partition between the air distribution chamber (which may simultaneously be the chamber for the power supply system) and the irradiation chamber is provided with rated breaking points; parts of the wall can be removed in the vicinity of these rated breaking points, to form flow openings.

In a simple, and at the same time compact, design of the light system, at least the portion of the system surrounding the light treatment chamber is a plastic injection-molded part, onto which a fan housing having a hanger for the fan motor is molded. This enables simple assembly, and the walls of the housing can be kept thin, for the sake of a compact structure.

Drawings

Further characteristics of the invention will become apparent from the following description of an exemplary embodiment, referring to the drawings, of which:

Detailed Description

Figure 1:
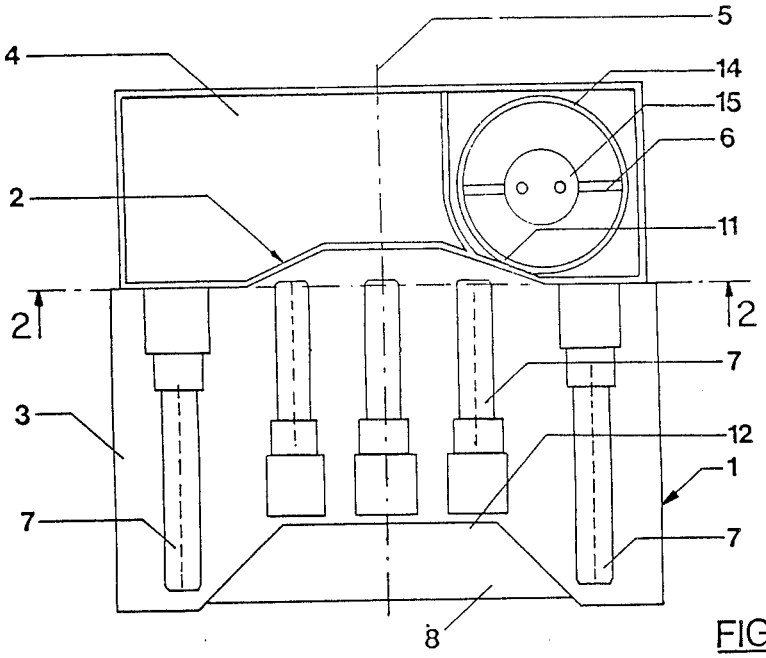
FIG. 1 is a plan view of a fingernail light system with the cover plate removed.
Figure 2:
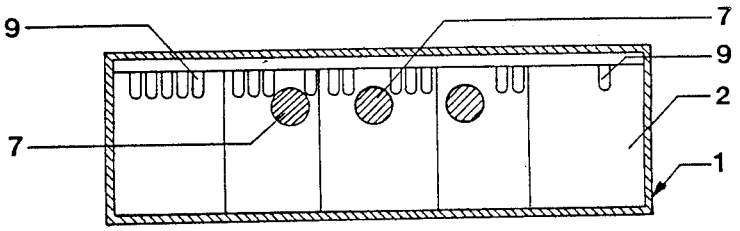
FIG. 2 is a cross section taken along the line II—II of FIG. 1.

As FIG. 1 shows, the housing 1 of the light system is divided by a wall 2 into an irradiation chamber 3 and a substantially closed air distribution chamber 4. A fan 6, offset laterally with respect to the central axis 5 of the housing 1, is located in the air distribution chamber 4 at a first airflow orifice. The rest of the air distribution chamber 4 serves to receive power supply elements, not shown in further detail, such as mains connection parts and chokes for irradiation lamps in the irradiation chamber 3.

In the vicinity of the top of the irradiation chamber 3, five irradiation lamps 7 in the form of fluorescent tubes are provided; the axis of the center irradiation lamp 7 coincides with the center axis 5 of the housing 1. Since the three middle irradiation lamps 7 serve to irradiate the fingernails of the index finger, ring finger and middle finger, they are oriented with their tube end toward the air distribution chamber 4, as seen from the generally hand-width housing opening 8, while the ends of the outer irradiation lamps 7 point in the opposite direction, since these tubes serve to irradiate the fingernails of the shorter thumb and little finger of the left or right hand placed there. The fingernails are inserted in a generally parallel orientation.

The wall 2 that divides the irradiation chamber 3 from the air distribution chamber 4 has an indentation 11 in its middle region, extending inward into the air distribution chamber 4 as seen from the irradiation chamber 3, so that the irradiation chamber 3 is enlarged in its middle region, that is, the region in which the middle finger, index finger and ring finger are located. On both sides of the center axis 5, the air distribution chamber 4 is no deeper (seen looking along the center axis 5) than necessary for the space required by fan 6.

Since the fan, positioned to one side of the housing 1, has a variable suction force along the wall 2, air openings 9 are provided along the wall, the number of which per unit of length of the wall increases with greater distance from the fan. In the region near the fan 6, where high suction action of the fan is present via its suction or compression side 11, depending on the type of ventilation, only a few of the air openings 9 are provided in the wall 2, while at a great distance from the fan 6, that is, toward the left side housing wall as seen in FIG. 1, there is a greater number of air openings 9.

Figure 3:
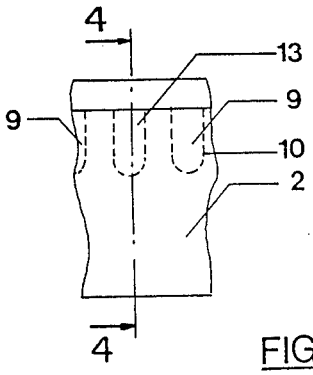
FIG. 3 is a detail showing the wall between the irradiation chamber and the air distribution chamber.
Figure 4:
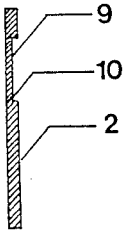
FIG. 4 is a section taken along the line IV—IV of FIG. 3.

As FIGS. 3 and 4 show, rated frangible panels or breaking points can be provided, spaced apart equally from one another, in the wall 2; these are represented by dashed lines 10, and at these points the wall 2 has a lesser thickness than the remaining wall portions, so that the number of air openings 9 can be fixed to meet given requirements. To form an air opening of this kind, the thin wall portions 13 are simply pushed out of the wall 2 along the rated breaking points.

The housing 1 is injection molded from two plastic parts, and on the bottom part a fan housing 14 surrounding the fan motor, not shown in further detail, and the fan wheel is molded on of plastic, with a hanger 15 for the fan motor.

Various changes and modifications may be made, and features described in connection with any one of the embodiments may be used with any of the others, within the scope of the inventive concept.

We claim:

1. Light system, in particular for curing photopolymerizable plastics on fingernails, having a housing (1) formed with a partitioning wall (2) defining within said housing a substantially closed air distribution chamber (4) and an irradiation chamber (3), said irradiation chamber being formed with a substantially hand-width opening (8) for generally parallel insertion of fingernails to be irradiated, means for supporting at least one irradiation lamp (7) in said irradiation chamber adjacent said fingernails, and a cover shielding said radiation lamp (7) from eyes of a user;

and a fan (6) for ventilating the irradiation chamber (3), the fan being located at a first airflow orifice in said substantially closed air distribution chamber (4)

wherein said partitioning wall (2) is formed with a plurality of openings (9) defining second airflow orifices in said substantially closed air distribution chamber (4), respective openings being arranged adjacent respective fingernails, said fan (6) is operable to cause airflow between said first and second airflow orifices and thence through said hand-width opening (8); and wherein, with increasing distance from the fan (6), the cross-sectional area of said openings increases, thereby tending to equalize airflow across respective ones of said fingernails.

2. A light system according to claim 1, wherein the fan (6) is located in the vicinity of one lateral end of the wall (2).

3. A light system according to claim 1, wherein the wall (2) has rated breaking points (10), in the vicinity of which wall portions (13) are removable to form further air openings (9), to adjust the ventilation.

4. A light system according to claim 2, wherein the wall (2) has rated breaking points (10), in the vicinity of which wall portions (13) are removable to form further air openings (9), to adjust the ventilation.

5. A light system according to claim 1, wherein the wall (2) is formed of plastic.

6. A light system according to claim 2, wherein the wall (2) is formed of plastic.

7. A light system according to claim 3, wherein the wall (2) is formed of plastic.

8. A light system according to claim 4, wherein the wall (2) is formed of plastic.

9. A light system according to claim 1, wherein at least the portion of the housing (1) enclosing the air distribution chamber (4) is an injection molded plastic part, onto which a fan housing (4) having a hangar (15) for the fan motor is molded.

10. A light system according to claim 2, wherein at least the portion of the housing (1) enclosing the air distribution chamber (4) is an injection molded plastic part, onto which a fan housing (4) having a hangar (15) for the fan motor is molded.

11. A light system according to claim 3, wherein at least the portion of the housing (1) enclosing the air distribution chamber (4) is an injection molded plastic part, onto which a fan housing (4) having a hangar (15) for the fan motor is molded.

12. A light system according to claim 4, wherein at least the portion of the housing (1) enclosing the air distribution chamber (4) is an injection molded plastic part, onto which a fan housing (4) having a hangar (15) for the fan motor is molded.

13. A light system according to claim 5, wherein at least the portion of the housing (1) enclosing the air distribution chamber (4) is an injection molded plastic part, onto which a fan housing (4) having a hangar (15) for the fan motor is molded.

14. A light system according to claim 6, wherein at least the portion of the housing (1) enclosing the air distribution chamber (4) is an injection molded plastic part, onto which a fan housing (4) having a hangar (15) for the fan motor is molded.

15. A light system according to claim 7, wherein at least the portion of the housing (1) enclosing the air distribution chamber (4) is an injection molded plastic part, onto which a fan housing (4) having a hangar (15) for the fan motor is molded.

16. A light system according to claim 8, wherein at least the portion of the housing (1) enclosing the air distribution chamber (4) is an injection molded plastic part, onto which a fan housing (4) having a hangar (15) for the fan motor is molded.

* * * * *